US005789129A

United States Patent [19]

Ochiai et al.

[11] Patent Number: 5,789,129

[45] Date of Patent: Aug. 4, 1998

[54] FERRITE CARRIER FOR ELECTROPHOTOGRAPHIC DEVELOPMENT

[75] Inventors: Masahisa Ochiai, Fukaya; Tsutomu Saitoh, Kumagaya, both of Japan

[73] Assignee: Hitachi Metals, Ltd., Tokyo, Japan

[21] Appl. No.: 769,432

[22] Filed: Dec. 19, 1996

[30] Foreign Application Priority Data

Dec. 22, 1995 [JP] Japan ..... 7-335036

[51] Int. Cl.[6] ..... G03G 9/107

[52] U.S. Cl. ..... 430/106.6; 430/108; 430/111; 252/62.61; 252/62.63; 252/62.64

[58] Field of Search ..... 430/106.6, 108, 430/111

[56] References Cited

U.S. PATENT DOCUMENTS 5,439,771 8/1995 Baba et al. ..... 430/108
5,500,320 3/1996 Saha ..... 430/106.6

FOREIGN PATENT DOCUMENTS 4-19546 3/1992 Japan .
6-51563 2/1994 Japan .

*Primary Examiner*—Roland Martin
*Attorney, Agent, or Firm*—Morgan, Lewis & Bockius LLP

[57] ABSTRACT

A ferrite carrier for use in electrophotographic development of electrostatic latent images, which comprises a ferrite particles having an average particle size of 10 to 100 μm, a specific resistivity of $10^6$ Ω.cm or more and a chemical composition represented by the following formula:

$$((MO)_Y(Li_2O)_{1-Y})_{1-X}(Fe_2O_3)_X$$

wherein M is at least one metal selected from the group consisting of Mn, Ni, Zn, Cu, Co, Mg and Ba, Y is a number of 0 to 1, and (1−X)/X is 1.23 to 3. A magnetization intensity ($\sigma_{1000}$) of the ferrite particle is 10 to 30 emu/g at 1000 Oe of a magnetic field strength, and a ratio ($\sigma_{500}/\sigma_S$) of a magnetization intensity ($\sigma_{500}$) of the ferrite particle and a saturation magnetization ($\sigma_S$) of the ferrite particle is 0.5 or more.

3 Claims, 1 Drawing Sheet

FERRITE CARRIER FOR ELECTROPHOTOGRAPHIC DEVELOPMENT

BACKGROUND OF THE INVENTION

The present invention relates to a ferrite carrier suitable as a component of a dry two-component developer for use in developing electrostatic latent image in electrophotography, electrostatic recording, electrostatic printing, etc.

In electrophotography, a photosensitive surface made of a photoconductive material of a photoconductive drum is uniformly electrostatically charged a suitable potential. The charged surface is exposed to light corresponding to images being reproduced to form an electrostatic latent image on the surface of the photoconductive drum. The latent image is developed by a colored fine powder, i.e., toner, to form a visual toner image. After transferring the visual image to a transfer sheet such as ordinary paper, etc., the transferred toner image is permanently fixed on the transfer sheet by heating or by applying pressure.

In the electrophotography described above, the development is generally accomplished by a magnetic brush method using a two-component developer comprising a toner and a magnetic carrier. In the two-component developer development, when the toner and the magnetic carrier are mixed together in a predetermined mixing ratio, the toner and the magnetic carrier acquire triboelectric charges of opposite polarities to allow the toner to cling to the magnetic carrier by electrostatic attraction. The magnetic carrier electrostatically retaining the toner is then supplied on the surface of a developing roller to form rotating magnetic brushes. The photoconductive surface containing the latent images is brought into brushing contact with the rotating magnetic brushes. During the brushing contact, only the toner is deposited on the image areas by electrostatic attraction between the latent image and the toner to produce visual toner images.

As the carrier of the two-component developer, iron powders, ferrite powders, etc. have been used in the art, and the carrier is classified according to the specific resistivity into two major groups of the electroconductive carrier and the insulating carrier. Bias voltage is applied, as required, between a sleeve of the developing roll and a photoconductive drum to achieve a high image quality with no fogging. In this case, the electroconductive carrier fails to provide a high image quality because it causes leakage of the charges of latent image and a carrier adhesion to the photoconductive surface. On the other hand, the insulating carrier can provide a satisfactory reproduction of thin lines because no leakage of the charges occurs in the use of the insulating carrier. However, since no charge is injected to the insulating carrier from the sleeve, charges having an opposite polarity to the toner remain in the carrier after the toner is moved from the carrier to the photoconductive drum, thus decreasing the developing electric field. As a result thereof, the central portion of solid blacks is likely to be low in the image density (a strong edge effect).

To solve this problem and to achieve a high image quality, JP-B-4-19546 proposes to regulate the magnetization intensity of the carrier at a magnetic field strength of 450 to 1000 Oe within 10 to 30 emu/g. This prior art teaches that the magnetization intensity within the above range reduces the carrier—carrier bond by magnetic attraction to allow the toner confined in the developer layer on the developing roll to participate in developing the latent images, thus providing a satisfactory image density using the insulating carrier. It is further taught therein that the carrier must have a composition represented by the formula: $(CuO)_{0.15-0.4}(ZnO)_{0-0.2}(Fe_2O_3)_{0.6-0.7}$ to attain the magnetization intensity of 10 to 30 emu/g. In this formula, the molar ratio of MO (M=Cu, Zn) to $Fe_2O_3$ is 0.43 to 0.67. However, such a ferrite containing $Fe_2O_3$ predominantly has a low specific resistivity to likely cause the carrier adhesion to the photoconductive surface. The specific resistivity can be increased by subjecting the carrier surface to oxidation treatment. However, this surface treatment adversely deteriorates the mechanical properties of the carrier and largely changes the triboelectrification property of the carrier. Alternatively, the carrier may be coated with a resin. However, the additional coating process increases the production cost, and there is another problem of cracking or exfoliation of the coating layer, which changes the triboelectrification efficiency and the resistivity of the developer. Further, a sintering temperature as high as 1200° C. or higher is needed when a ferrite carrier contains iron oxide in a large amount, thus increasing the production cost.

JP-A-6-51563 proposes to regulate the magnetization intensity of the carrier at a magnetic field strength of 1000 Oe within 30 to 150 emu/cm$^3$. However, the magnetization intensity of such a range makes the carrier—carrier bond by magnetic attraction still high for full color development. A high carrier—carrier bond is likely to cause color blending because a color image is scraped by rigid magnetic brushes in the subsequent superimposition of another color, or cause streaks or uneven image density in black and white reproduction of halftones.

OBJECT AND SUMMARY OF THE INVENTION

Accordingly, an object of the present invention is to solve the above problems in the prior art and provide a ferrite carrier for electrophotographic development, which minimizes the carrier adhesion to the photoconductive surface although low in magnetic force, and ensures a development faithful to the latent image.

As a result of the intense research, the inventors have found that the above object can be achieved by using a carrier comprising a ferrite particle having a specific chemical composition and specific magnetic properties.

Thus, in a first aspect of the present invention, there is provided a ferrite carrier for use in electrophotographic development of electrostatic latent images, which comprises a ferrite particles having an average particle size of 10 to 100 μm, a specific resistivity of $10^6$ Ω.cm or more and a chemical composition represented by the following formula:

$$((MO)_Y(Li_2O)_{1-Y})_{1-X}(Fe_2O_3)_X$$

wherein M is at least one metal selected from the group consisting of Mn, Ni, Zn, Cu, Co, Mg and Ba, Y is a number of 0 to 1, and (1−X)/X is 1.23 to 3. The ferrite particle has a magnetization intensity ($\sigma_{1000}$) of 10 to 30 emu/g at 1000 Oe of a magnetic field strength, and a ratio of a magnetization intensity ($\sigma_{500}$) and a saturation magnetization ($\sigma_S$) is 0.5 or more.

The foregoing and other objects, features and advantages of the invention will be apparent from the following detailed description of the invention.

DETAILED DESCRIPTION OF THE INVENTION

Figure 1:
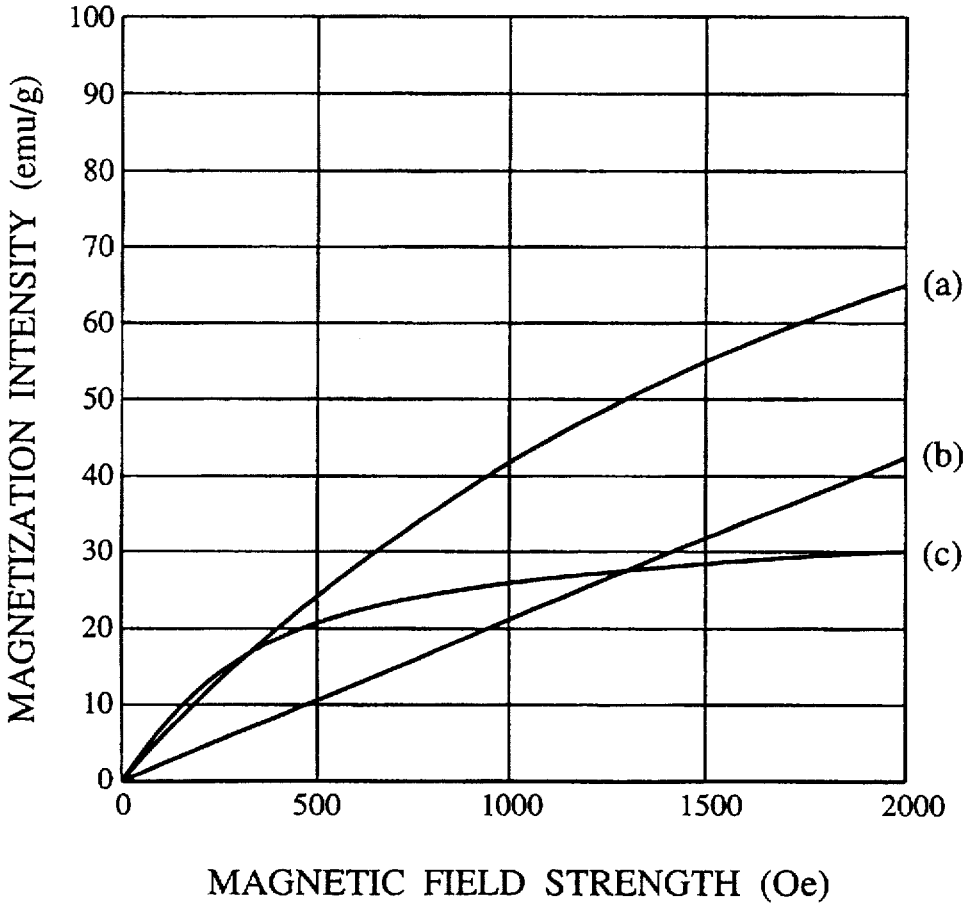
FIG. 1 is a graph showing magnetization characteristics of several carriers.

In FIG. 1, the magnetization characteristics of a ferrite carrier (a) ($CuO/ZnO/Fe_2O_3$=20/10/70 (mol %); average particle size=40 μm; specific resistivity=$10^8$ Ω.cm) conventionally used in the art, an iron carrier (b) and a ferrite carrier (c) ($CuO/ZnO/Fe_2O_3$=50/20/30 (mol %); average particle size=40 μm; specific resistivity=$10^8$ Ω.cm) of the present invention are shown.

Since the ferrite carrier (a) has a high magnetization intensity, the carrier—carrier bond by magnetic attraction becomes too strong. The strong carrier—carrier bond in turn makes the magnetic brushes high and rigid. In full color development in which colors are successively superimposed on the latent images, a color image is scraped by the high and rigid magnetic brushes in the subsequent superimposition of another color, and as a result thereof, roughened image, white spots, color blending, etc. frequently occur in the reproduced images. In black and white development, a halftone subject is reproduced with streaks and uneven image density. Further, the strong carrier—carrier bond reduces the fluidity of the developer particles, thus making the toner inside the developer layer difficult to participate in developing the latent image to result in a low image density. The present inventors have found that a magnetization intensity at a magnetic field strength of 1000 Oe ($\sigma_{1000}$) is preferred to be 30 emu/g or less in view of regulating the carrier—carrier bond to a moderate level and obtaining high image quality. However, if $\sigma_{1000}$ is too low, the ferrite particle easily leaves the surface of the developing roll to adhere to the photoconductive surface (carrier adhesion). To prevent the carrier adhesion, $\sigma_{1000}$ is required to be 10 emu/g or more. A more preferred range of $\sigma_{1000}$ is 20 to 30 emu/g.

The iron carrier (b) shows linear magnetization characteristics and has a magnetization intensity falling within the range of 10 to 30 emu/g at a magnetic field strength of 1000 Oe. The magnetic field on the surface of the developing roll is provided by a plurality of magnetic poles circumferentially disposed on a magnet roll. The developer is attracted to the surface of the developing roll by this magnetic field. However, since the magnetic field is low in the regions between the two adjacent magnetic poles as compared with on the magnetic poles, the carrier is weakly attracted to the developing roll. Therefore, if the carrier—carrier bond is so regulated as to be suitable on the magnetic poles, the bond is too weak in the inter-pole regions and the carrier leaves from the developing roll to result in the carrier adhesion. On the other hand, if the carrier—carrier bond is so regulated as to be suitable in the inter-pole region, the bond becomes too strong on the magnetic poles to form high and rigid magnetic brushes to cause the problems as describe above.

Therefore, the carrier—carrier bond is needed to be so regulated as to prevent the carrier from leaving the developing roll in the inter-pole regions. The present inventors have found that a ferrite particle exhibiting a magnetization characteristic curve having a prompt rising, as in the case of the ferrite carrier (c), can meet this requirement. Such a magnetization characteristic curve having a prompt rising may be characterized by the ratio of the magnetization intensity at 500 Oe magnetic field ($\sigma_{500}$) and the saturation magnetization ($\sigma_S$). The ratio: $\sigma_{500}/(\sigma_S$ is 0.5 or more, preferably 0.6 or more to meet the above requirement. When the ratio is less than 0.5, the characteristic curve becomes linear as in the case of the iron carrier (b), and the carrier—carrier bonds on the magnetic poles and in the inter-pole regions are difficult to be regulated to optimum level.

As described above, a carrier which prevents the carrier adhesion although it has a relatively low magnetization intensity can be attained by a ferrite particle having the magnetization characteristic curve as shown by (c) in FIG. 1, namely, a ferrite particle having a magnetization intensity of 10 to 30 emu/g at 1000 Oe magnetic field strength and a magnetization characteristic curve having prompt rising with respect to the increasing magnetic field strength.

The ferrite particle of the present invention has the following general formula: $((MO)_Y(Li_2O)_{1-Y})_{1-X}(Fe_2O_3)_X$. In the formula, M is at least one metal selected from the group consisting of Mn, Ni, Zn, Cu, Co, Mg and Ba, and combinations of Zn and at least one of Cu, Ni, Mn and Mg, and a combination of Li and Mn are preferable. The molar ratio of 1−X and X ((1−X)/X) is 1.23 to 3, preferably 1.5 to 3, and more preferably 2 to 2.5. When the ratio is less than 1.23, the specific resistivity of the carrier is low to cause the carrier adhesion. When the ratio exceeds 3, the ferrite particle is not suitable for use as the magnetic carrier because the magnetization intensity thereof is too low. Y is a number of 0 to 1, preferably 0.5 to 1.

The weight-average particle size of the ferrite carrier of the present invention is preferably 10 to 100 μm, more preferably 10 to 40 μm. When the average particle size is less than 10 μm, the carrier adhesion is likely to occur due to its low magnetization intensity. An average particle size exceeding 100 μm is undesirable because it provides coarse image.

In the present invention, the specific resistivity of the ferrite carrier is $10^6$ Ω.cm or more, preferably $10^8$ Ω.cm or more. When the specific resistivity is less than $10^6$ Ω.cm, the carrier is likely to leave the magnetic brush to cause the carrier adhesion.

The ferrite carrier of the present invention may be produced, for example, by the following method. The metal oxide (MO and $Li_2O$), iron oxide ($Fe_2O_3$) and optionally a metal compound, such as $V_2O_5$, $Bi_2O_3$, etc. up to 2 weight %, as a sintering aid are mechanically mixed in a predetermined ratio. The mixture is calcined at 800° to 1000° C. for several hours, and then pulverized to have a particle size of several μm or less. The powder thus obtained is subjected to granulation by spray-drying in a heated atmosphere, after adding a binder, if desired. The spherical granulate thus obtained is then subjected to sintering at 900° to 1200° C. for several hours in air, disintegration and classification to obtain the ferrite carrier of the present invention.

The ferrite carrier thus produced may be further subjected to a surface oxidation treatment or coated with a resin, if desired, to regulate the specific resistivity.

Suitable resin for coating the ferrite carrier may include homopolymers or copolymers of styrene compounds such as parachlorostyrene, methylstyrene, etc.; vinyl halides such as vinyl chloride, vinyl bromide, vinyl fluoride, etc.; vinyl esters such as vinyl acetate, vinyl propionate, vinyl benzoate, etc.; acrylic compounds such as methyl acrylate, ethyl acrylate, butyl acrylate, isobutyl acrylate, dodecyl acrylate, n-octyl acrylate, 3-chloroethyl acrylate, phenyl acrylate, methyl α-chloroacrylate, butyl methacrylate, acrylonitrile, methacrylonitrile, acrylamide, etc.; vinyl ethers such as vinyl methyl ether, vinyl isobutyl ether, vinyl ethyl ether, etc.; vinyl ketones such as vinyl ethyl ketone, vinyl hexyl ketone, methyl isopropenyl ketone, etc. Other resins such as epoxy resins, silicone resins, rosin-modified phenol-formaldehyde resins, cellulose resins, polyether resins, polyvinyl butyral resins, polyester resins, styrene-butadiene resins, polyurethane resins, polycarbonate resins, fluorohydrocarbon resins such as polytetrafluoroethylene, etc. may be also usable. These resin materials may be used alone or in combination. Among them, styrene-acrylic resins, silicone resins, epoxy resins, styrene-butadiene resins, cellulose resins, etc. are particularly preferable.

The ferrite carrier may be coated with the above resin according to the following method. First, the resin material is dissolved in an adequate solvent such as benzene, toluene, xylene, methyl ethyl ketone, tetrahydrofuran, chloroform, hexane, etc., to produce a resin solution or emulsion. The resin solution or emulsion is sprayed onto the ferrite carrier to form a uniform resin layer on the surface of the ferrite carrier. To obtain the uniform resin layer, the magnetic carrier are preferably maintained in a fluidized state desirably by employing a spray dryer or a fluidized bed. The resin solution is sprayed at about 200° C. or lower, preferably at about 100°–150° C., to simultaneously carry out the rapid removing of a solvent from the resultant resin layer and the drying of the resin layer. The resin emulsion is sprayed at a temperature from room temperature to 100° C. to adhere the fused resin on the surface of the ferrite carrier. The amount of the resin coated on the ferrite carrier is 0.5 to 2.5 parts by weight base on 100 parts by weight of the ferrite carrier.

The carrier of the present invention is mixed with a toner to give a two-component developer. The toner preferably comprises a binder resin, a colorant and an optional component such as a charge-controlling agent, a magnetic powder, a release agent, a fluidity improver, etc., and preferably has a volume-average particle size of 5 to 15 μm.

As the binder resin, a polyester resin is used for a negatively chargeable toner and a styrene-acryl copolymer resin for a positively chargeable toner.

The material for the colorant may include carbon black, aniline blue, Chalco oil blue, chrome yellow, ultramarine blue, Du Pont oil red, quinoline yellow, methylene blue chloride, phthalocyanine blue, malachite green oxalate, lamp black, rose bengal, etc. The colorant is contained 5 to 15 weight % based on the total weight of the negatively chargeable toner, and 1 to 20 weight % based on the total weight of the positively chargeable toner.

The content of the toner in the developer is 3 to 10 weight % for the non-magnetic toner and 15 to 70 weight % for the magnetic toner, each based on the total weight of the developer.

In the present invention, the magnetization intensity of the carrier were measured as follows. The carrier was densely packed in a hollow plastic cylinder to have a predetermined volume. The cylinder was placed in a magnetic field of ±10 kOe to obtain hysteresis curve by using a vibrating magnetometer (VSM-3 manufactured by Toei Kogyo K.K.). The magnetic moment obtained from the hysteresis curve was divided by the weight of the sample to calculate the magnetization intensity.

The specific resistivity was determined as follows. An appropriate amount of the carrier was charged into a cylinder made of Teflon (trade mark) and having a diameter of 30 mm to a height of 5 mm. The sample was exposed to an electric field of D.C. 200 V/cm under a load of about 800 gf to measure the resistance.

The weight-average particle size of the carrier was calculated from a particle size distribution obtained by a multi-sieve shaking machine.

The volume-average particle size of the toner was measured by a particle size analyzer (Coulter Counter Model TA-II manufactured by Coulter Electronics Co.) The triboelectric charge of the toner was determined using a magnetic developer having a toner content of 5 weight % by using a triboelectric charge measuring apparatus (TB-200 manufactured by Toshiba Chemical Co. Ltd.).

The present invention will be further described while referring to the following Examples which should be considered to illustrate various preferred embodiments of the present invention.

EXAMPLE 1

Each of powder of CuO (50 mole %), ZnO (20 mole %) and $Fe_2O_3$ (30 mole %) (1−X=0.7, X=0.3, (1−X)/X=2.33) was mixed in a ball mill. The powder mixture thus obtained was calcined at 900° C. for 2 hours, and then pulverized by an attritor. The average particle size of the pulverized powder was about 0.7 μm. After adding polyvinyl alcohol (PVA) in an amount of 0.5 to 1.0 weight %, the powder was spray-dried by using a spray drier to form the powder into granule. The granule thus obtained was sintered in an aluminum vessel at 1000° C. for 3 hours in air, disintegrated and classified to prepare a ferrite carrier having the following properties.

| | |
|---|---|
| Weight-average particle size | 40 μm |
| Specific Resistivity | $10^8$ Ω · cm |
| $\sigma_{500}$ | 20 emu/g |
| $\sigma_{1000}$ | 24 emu/g |
| $\sigma_S$ | 29 emu/g |
| $\sigma_{500}/\sigma_S$ | 0.69 |

Separately, a negative chargeable non-magnetic toner was prepared as follows. 4 parts (by weight, and the same applies hereinafter) of phthalocyanine blue (BASF ) and 1 part of a charge-controlling agent (Bontron E88, Orient Chemical Industries) were pre-mixed in a ball mill, and the mixing was continued after adding 93 parts of bisphenol A-type polyester (binder resin) and 2 parts of polypropylene (TP-32, Sanyo Chemical Industries, Ltd.). The resulting mixture was melt-kneaded at 150° C. in a twin-screw kneader, and cooled. The cooled product was coarsely pulverized by a mechanical pulverizer until the pulverized powder passed through a wire gauze of 1 mm mesh, and further finely pulverized by an air pulverizer (jet mill). The fine powder was then classified by an air classifier to collect a powder having a volume-average particle size of about 8 μm. The classified powder was mixed with 0.5 parts of hydrophobic silica (fluidity improver, Aerosil R972 manufactured by Nippon Aerosil K.K.), thereby producing a negatively chargeable magnetic toner. The toner had a specific volume resistance of $10^{14}$ Ω.cm and a triboelectric charge of −35 μC/g.

A two-component developer was prepared by mixing 97 parts by weight of the above ferrite carrier and 3 parts by weight of the above toner. By using the developer thus prepared, a printing test was conducted under the following conditions:

Developing Method: Full color superimposing development

Photoconductive Drum: Negatively chargeable OPC (30 mm diameter), Process speed: 60 mm/sec Surface potential: −600 V Magnet Roll: Stationary Four magnetic poles (asymmetric)

Developing magnetic pole (800 G)

Other magnetic poles (600 G)

Sleeve: SUS304 (20 mm diameter)

Peripheral speed: 150 mm/sec

Bias voltage: 450 V (DC) superposed by 1000 $V_{pp}$ AC (1 kHz)

Developing Gap: 0.4 mm

Doctor Gap: 0.3 mm

Temperature: 20° C.

Humidity: 60% (RH)

The toner image was transferred to ordinary paper and fixed by heat roll method at 160° C. under a line pressure of 1 kgf/cm.

The results of the printing test are shown in Table 1. The obtained image was excellent in reproduction of thin lines, which is characteristic in the insulating carrier, and had a sufficient image density in solid blacks with no edge effect. Since the magnetization intensity of the carrier was low, the developer layer and the magnetic brushes were soft and flexible, which resulted in a satisfactory reproduction of halftones with no color blending. Further, the carrier adhesion was well prevented because the carrier showed a relatively high magnetization intensity at a low magnetic field strength.

EXAMPLE 2

Each powder of CuO (38 mole %), ZnO (20 mole %) and $Fe_2O_3$ (42 mole %) (1−X=0.58, X=0.42, (1−X)/X=1.38) was mixed in a ball mill. The powder mixture thus obtained was subjected to the same treatments as in Example 1 except for sintering at 1050° C. to prepare a ferrite carrier having the following properties.

| | |
|---|---|
| Weight-average particle size | 40 μm |
| Specific Resistivity | $10^8$ Ω · cm |
| $\sigma_{500}$ | 25 emu/g |
| $\sigma_{1000}$ | 30 emu/g |
| $\sigma_S$ | 42 emu/g |
| $\sigma_{500}/\sigma_S$ | 0.60 |

A developer was prepared in the same manner as in Example 1 from the toner prepared in Example 1 and the above carrier, and the print test was conducted in the same manner as in Example 1. The results are shown in Table 1.

EXAMPLE 3

Each powder of CuO (45 mole %), ZnO (30 mole %) and $Fe_2O_3$ (25 mole %) (1−X=0.75, X=0.25, (1−X)/X=3.00) was mixed in a ball mill. The powder mixture thus obtained was subjected to the same treatment as in Example 1 except for sintering at 950° C. to prepare a ferrite carrier having the following properties.

| | |
|---|---|
| Weight-average particle size | 40 μm |
| Specific Resistivity | $10^8$ Ω · cm |
| $\sigma_{500}$ | 15 emu/g |
| $\sigma_{1000}$ | 20 emu/g |
| $\sigma_S$ | 26 emu/g |
| $\sigma_{500}/\sigma_S$ | 0.58 |

A developer was prepared in the same manner as in Example 1 from the toner prepared in Example 1 and the above carrier, and the print test was conducted in the same manner as in Example 1. The results are shown in Table 1.

Comparative Example 1

Each powder of CuO (30 mole %), ZnO (20 mole %) and $Fe_2O_3$ (50 mole %) (1−X=0.50, X=0.50, (1−X)/X=1.00) was mixed in a ball mill. The powder mixture thus obtained was subjected to the same treatment as in Example 1 except for sintering at 1200° C. to prepare a ferrite carrier having the following properties.

| | |
|---|---|
| Weight-average particle size | 40 μm |
| Specific Resistivity | $10^8$ Ω · cm |
| $\sigma_{500}$ | 45 emu/g |
| $\sigma_{1000}$ | 60 emu/g |
| $\sigma_S$ | 70 emu/g |
| $\sigma_{500}/\sigma_S$ | 0.64 |

A developer was prepared in the same manner as in Example 1 from the toner prepared in Example 1 and the above carrier, and the print test was conducted in the same manner as in Example 1. The results are shown in Table 1.

The carrier used here had (1−X)/X exceeding the range of the present invention. Since $\sigma_{500}/\sigma_S$ of the carrier fell in the range of the present invention, no carrier adhesion occurred. However, $\sigma_{1000}$ was far larger than the range of the present invention, the color blending occurred and the halftone images with uneven image density were obtained.

Comparative Example 2

Each powder of CuO (62 mole %), ZnO (20 mole %) and $Fe_2O_3$ (18 mole %) (1−X=0.82, X=0.18, (1−X)/X=4.56) was mixed in a ball mill. The powder mixture thus obtained was subjected to the same treatment as in Example 1 except for sintering at 950° C. to prepare a ferrite carrier having a specific resistivity of $10^8$ Ω.cm. The ferrite carrier obtained here was not magnetized, and therefore, a considerable carrier adhesion occurred and images of a low image density were reproduced.

EXAMPLE 4

Each powder of $Li_2O$ (30 mole %), MnO (32 mole %) and $Fe_2O_3$ (38 mole %) (1−X=0.62, X=0.38, (1−X)/X=1.63) was mixed in a ball mill. The powder mixture thus obtained was subjected to the same treatment as in Example 1 except for sintering at 1150° C. to prepare a ferrite carrier having the following properties.

| | |
|---|---|
| Weight-average particle size | 40 μm |
| Specific Resistivity | $10^7$ Ω · cm |
| $\sigma_{500}$ | 25 emu/g |
| $\sigma_{1000}$ | 29 emu/g |
| $\sigma_S$ | 40 emu/g |
| $\sigma_{500}/\sigma_S$ | 0.63 |

A developer was prepared in the same manner as in Example 1 from the toner prepared in Example 1 and the above carrier, and the print test was conducted in the same manner as in Example 1. The results are shown in Table 1.

Comparative Example 3

Each powder of $Li_2O$ (40 mole %), MnO (34 mole %) and $Fe_2O_3$ (26 mole %) (1−X=0.74, X=0.26, (1−X)/X=2.85) was mixed in a ball mill. The powder mixture thus obtained was subjected to the same treatment as in Example 1 except for sintering at 1050° C. to prepare a ferrite carrier having the following properties.

| | |
|---|---|
| Weight-average particle size | 40 μm |
| Specific Resistivity | $10^8$ Ω · cm |
| $\sigma_{500}$ | 12 emu/g |
| $\sigma_{1000}$ | 21 emu/g |
| $\sigma_S$ | 31 emu/g |
| $\sigma_{500}/\sigma_S$ | 0.39 |

A developer was prepared in the same manner as in Example 1 from the toner prepared in Example 1 and the above carrier, and the print test was conducted in the same manner as in Example 1. The results are shown in Table 1.

The ferrite carrier used here had a ratio of $\sigma_{500}/\sigma_S$ far smaller than the range of the present invention, and therefore, a considerable carrier adhesion occurred.

EXAMPLE 5

Each powder of NiO (50 mole %), ZnO (20 mole %) and $Fe_2O_3$ (30 mole %) (1−X=0.70, X=0.30, (1−X)/X=2.33) was mixed in a ball mill. The powder mixture thus obtained was subjected to the same treatment as in Example 1 except for sintering at 1100° C. to prepare a ferrite carrier having the following properties.

| | |
|---|---|
| Weight-average particle size | 40 μm |
| Specific Resistivity | $10^6$ Ω · cm |
| $\sigma_{500}$ | 20 emu/g |
| $\sigma_{1000}$ | 25 emu/g |
| $\sigma_S$ | 30 emu/g |
| $\sigma_{500}/\sigma_S$ | 0.67 |

A developer was prepared in the same manner as in Example 1 from the toner prepared in Example 1 and the above carrier, and the print test was conducted in the same manner as in Example 1. The results are shown in Table 1.

EXAMPLE 6

Each powder of MnO (50 mole %), ZnO (20 mole %) and $Fe_2O_3$ (30 mole %) (1−X=0.70, X=0.30, (1−X)/X=2.33) was mixed in a ball mill. The powder mixture thus obtained was subjected to the same treatment as in Example 1 except for sintering at 1100° C. to prepare a ferrite carrier having the following properties.

| | |
|---|---|
| Weight-average particle size | 40 μm |
| Specific Resistivity | $10^8$ Ω · cm |
| $\sigma_{500}$ | 15 emu/g |
| $\sigma_{1000}$ | 20 emu/g |
| $\sigma_S$ | 25 emu/g |
| $\sigma_{500}/\sigma_S$ | 0.60 |

A developer was prepared in the same manner as in Example 1 from the toner prepared in Example 1 and the above carrier, and the print test was conducted in the same manner as in Example 1. The results are shown in Table 1.

EXAMPLE 7

Each powder of MgO (50 mole %), ZnO (20 mole %) and $Fe_2O_3$ (30 mole %) (1−X=0.70, X=0.30, (1−X)/X=2.33) was mixed in a ball mill. The powder mixture thus obtained was subjected to the same treatment as in Example 1 except for sintering at 1100° C. to prepare a ferrite carrier having the following properties.

| | |
|---|---|
| Weight-average particle size | 40 μm |
| Specific Resistivity | $10^8$ Ω · cm |
| $\sigma_{500}$ | 15 emu/g |
| $\sigma_{1000}$ | 20 emu/g |
| $\sigma_S$ | 25 emu/g |
| $\sigma_{500}/\sigma_S$ | 0.60 |

A developer was prepared in the same manner as in Example 1 from the toner prepared in Example 1 and the above carrier, and the print test was conducted in the same manner as in Example 1. The results are shown in Table 1.

EXAMPLE 8

100 parts by weight of the ferrite carrier of Example 1 were coated with 1.5 parts by weight of silicone resin by fluidized bed coating method to obtain a resin-coated ferrite carrier having the following properties.

| | |
|---|---|
| Weight-average particle size | 40 μm |
| Specific Resistivity | $10^{10}$ Ω · cm |
| $\sigma_{500}$ | 20 emu/g |
| $\sigma_{1000}$ | 24 emu/g |
| $\sigma_S$ | 29 emu/g |
| $\sigma_{500}/\sigma_S$ | 0.69 |

A developer was prepared in the same manner as in Example 1 from the toner prepared in Example 1 and the above carrier, and the print test was conducted in the same manner as in Example 1. The results are shown in Table 1.

EXAMPLE 9

The same procedures as in Example 1 were repeated except for collecting a ferrite carrier having an average particle size of 20 μm by changing the classifying condition. The ferrite carrier was coated with silicone resin in the same manner as in Example 8 except for changing the amount of the silicone resin to 2.0 parts by weight to prepare a resin-coated ferrite carrier having the following properties.

| | |
|---|---|
| Weight-average particle size | 20 μm |
| Specific Resistivity | $10^{12}$ Ω · cm |
| $\sigma_{500}$ | 20 emu/g |
| $\sigma_{1000}$ | 24 emu/g |
| $\sigma_S$ | 29 emu/g |
| $\sigma_{500}/\sigma_S$ | 0.69 |

A developer was prepared in the same manner as in Example 1 from the toner prepared in Example 1 and the above carrier, and the print test was conducted in the same manner as in Example 1. The results are shown in Table 1.

Comparative Example 4

The same procedures as in Example 1 were repeated except for collecting a ferrite carrier having an average particle size of 120 μm by changing the classifying condition. The ferrite carrier was coated with silicone resin in the same manner as in Example 8 except for changing the amount of the silicone resin to 1.0 part by weight to prepare a resin-coated ferrite carrier having the following properties.

| | |
|---|---|
| Weight-average particle size | 120 μm |
| Specific Resistivity | $10^{13}$ Ω · cm |
| $\sigma_{500}$ | 20 emu/g |
| $\sigma_{1000}$ | 24 emu/g |
| $\sigma_S$ | 29 emu/g |
| $\sigma_{500}/\sigma_S$ | 0.69 |

A developer was prepared in the same manner as in Example 1 from the toner prepared in Example 1 and the above carrier, and the print test was conducted in the same manner as in Example 1. The results are shown in Table 1.

Although the ferrite carrier prepared here had the composition of the present invention and met the magnetic properties required in the present invention, the carrier easily left the sleeve and caused a significant carrier adhesion due to its large particle size. Further, the large particle size of the carrier caused an unstable toner moving from the magnetic brushes to the photoconductive surface to result in an uneven image density in halftones and the color blending.

TABLE 1

| No. | Composition (mole %) MO | 1-X | $Li_2O$ | $Fe_2O_3$ X | (1 − X)/X | Average Particle Size (μm) | Sintering Temp. (°C.) | Specific Resistivity (Ω · cm) |
|---|---|---|---|---|---|---|---|---|
| | | | | Example | | | | |
| 1 | CuO 50 | ZnO 20 | — | 30 | 2.33 | 40 | 1000 | $10^8$ |
| 2 | CuO 38 | ZnO 20 | — | 42 | 1.38 | 40 | 1050 | $10^8$ |
| 3 | CuO 45 | ZnO 30 | — | 25 | 3.00 | 40 | 950 | $10^8$ |
| | | | | Comparative Example | | | | |
| 1 | CuO 30 | ZnO 20 | — | 50 | 1.00 | 40 | 1200 | $10^8$ |
| 2 | CuO 62 | ZnO 20 | — | 18 | 4.56 | 40 | 950 | $10^8$ |
| | | | | Example | | | | |
| 4 | MnO 32 | — | $Li_2O$ 30 | 38 | 1.63 | 40 | 1150 | $10^7$ |
| | | | | Comparative Example | | | | |
| 3 | MnO 34 | — | $Li_2O$ 40 | 26 | 2.85 | 40 | 1050 | $10^8$ |
| | | | | Example | | | | |
| 5 | NiO 50 | ZnO 20 | — | 30 | 2.33 | 40 | 1100 | $10^6$ |
| 6 | MnO 50 | ZnO 20 | — | 30 | 2.33 | 40 | 1100 | $10^8$ |
| 7 | MgO 50 | ZnO 20 | — | 30 | 2.33 | 40 | 1100 | $10^8$ |
| 8 | CuO 50 | ZnO 20 resin coating | — | 30 | 2.33 | 40 | 1000 | $10^{10}$ |
| 9 | CuO 50 | ZnO 20 resin coating | — | 30 | 2.33 | 20 | 1000 | $10^{12}$ |
| | | | | Comparative Example | | | | |
| 4 | CuO 50 | ZnO 20 resin coating | — | 30 | 2.33 | 120 | 1000 | $10^{13}$ |

| No. | Magnetization intensity (emu/g) $\sigma_{500}$ | $\sigma_{1000}$ | $\sigma_S$ | $\sigma_{500}/\sigma_S$ | Image Density | Image Quality: Halftones | Color Blending | Carrier Adhesion |
|---|---|---|---|---|---|---|---|---|
| | | | | Example | | | | |
| 1 | 20 | 24 | 29 | 0.69 | 1.42 | good | none | none |
| 2 | 25 | 30 | 42 | 0.60 | 1.39 | good | none | none |
| 3 | 15 | 20 | 26 | 0.58 | 1.40 | good | none | none |
| | | | | Comparative Example | | | | |
| 1 | 45 | 60 | 70 | 0.64 | 1.41 | uneven density | occurred | none |
| 2 | | not magnetized | — | 0.75 | good | none | occurred | |
| | | | | Example | | | | |
| 4 | 25 | 29 | 40 | 0.63 | 1.38 | good | none | none |
| | | | | Comparative Example | | | | |
| 3 | 12 | 21 | 31 | 0.39 | 1.41 | good | none | occurred |
| | | | | Example | | | | |
| 5 | 20 | 25 | 30 | 0.67 | 1.40 | good | none | none |

TABLE 1-continued

| | | | | | | | | |
|---|---|---|---|---|---|---|---|---|
| 6 | 15 | 20 | 25 | 0.60 | 1.42 | good | none | none |
| 7 | 15 | 20 | 25 | 0.60 | 1.37 | good | none | none |
| 8 | 20 | 24 | 29 | 0.69 | 1.41 | good | none | none |
| 9 | 20 | 24 | 29 | 0.69 | 1.39 | good | none | none |
| | | | | Comparative Example | | | | |
| 4 | 20 | 24 | 29 | 0.69 | 1.41 | uneven density | occurred | occurred |

As described above, the ferrite carrier of the present invention suffers from no carrier adhesion in spite of its low magnetization intensity at 1000 Oe of the magnetic field strength, because it has a relatively large magnetization intensity at 500 Oe of the magnetic field strength. Therefore, the ferrite carrier of the present invention provides high quality images faithful to the electrostatic latent images in an electrophotographic reproduction.

What is claimed is:

1. A ferrite carrier for use in electrophotographic development of electrostatic latent images, which comprises a ferrite particle having an average particle size ranging from 10 to 100 μm, a specific resistivity of $10^6$ Ω.cm or more and a chemical composition represented by the following formula:

$$((MO)_Y(Li_2O)_{1-Y})_{(1-X)}(Fe_2O_3)_X$$

wherein M is at least one metal selected form the group consisting of Mn, Ni, Zn, Cu, Co, Mg, and Ba, Y is a number ranging from 0 to 1, and (1–X)/X ranges from 1.23 to 3, wherein said ferrite particle has a magnetization intensity ($\sigma_{1000}$) ranging from 10 to 30 emu/g at 1000 Oe of magnetic field strength, and a magnetization intensity ($\sigma_{500}$) and a saturation magnetization ($\sigma_S$) which satisfies the following relationship: $\sigma_{500}/\sigma_S \geqq 0.5$.

2. The ferrite carrier according to claim 1, wherein M is a combination of Zn and at least one of Cu, Ni, Mn and Mg, and Y is 1.

3. The ferrite carrier according to claim 1, wherein M is Mn and Y is a number larger than 0 and smaller than 1.

* * * * *